US005303867A

United States Patent [19]

Peterson

[11] Patent Number: 5,303,867

[45] Date of Patent: Apr. 19, 1994

[54] TRIGGER OPERATED FLUID DISPENSING DEVICE

[75] Inventor: Robert J. Peterson, Cincinnati, Ohio

[73] Assignee: The Procter & Gamble Company, Cincinnati, Ohio

[21] Appl. No.: 82,001

[22] Filed: Jun. 24, 1993

[51] Int. Cl.[5] ..... B65D 37/00; B05B 9/043; B05B 11/02

[52] U.S. Cl. ..... 239/333; 239/468; 239/471; 222/207; 222/383

[58] Field of Search ..... 239/329, 331, 333, 463, 239/468, 471; 222/207, 383

[56] References Cited

U.S. PATENT DOCUMENTS

| | | | |
|---|---|---|---|
| 3,897,006 | 7/1975 | Tada | 239/333 |
| 3,973,700 | 8/1976 | Schmidt et al. | 222/207 X |
| 3,995,774 | 12/1976 | Cooprider et al. | 222/207 |
| 4,168,788 | 9/1979 | Quinn | 239/333 X |
| 4,199,083 | 4/1980 | LoMaglio | 222/207 |
| 4,204,614 | 5/1980 | Reeve | 222/207 X |
| 4,225,061 | 9/1980 | Blake et al. | 222/207 |
| 4,260,079 | 4/1981 | Cary et al. | 222/209 |
| 4,273,290 | 6/1981 | Quinn | 239/333 X |
| 4,336,895 | 6/1982 | Aleff | 222/207 |
| 4,489,861 | 12/1984 | Saito et al. | 222/207 |
| 4,655,690 | 4/1987 | Boedecker et al. | 417/53 |
| 4,858,788 | 8/1989 | Meckenstock | 222/207 |
| 4,863,070 | 9/1989 | Andris | 222/207 |
| 4,898,307 | 2/1990 | Tiramani | 222/207 |
| 5,014,881 | 5/1991 | Andris | 222/207 |
| 5,018,894 | 5/1991 | Goncalves | 401/202 |
| 5,114,052 | 5/1993 | Tiramani et al. | 222/207 |

FOREIGN PATENT DOCUMENTS

| | | |
|---|---|---|
| WO 92/22495 | 6/1991 | European Pat. Off. . |
| 0520315 | 12/1992 | European Pat. Off. . |
| 2305365 | 3/1975 | France . |
| 2380077 | 9/1978 | France . |
| 2621557A | 10/1987 | France . |
| 2630712A | 4/1988 | France . |

*Primary Examiner*—Andres Kashnikow
*Assistant Examiner*—William Grant
*Attorney, Agent, or Firm*—John M. Howell; E. Kelly Linman; Kevin C. Johnson

[57] ABSTRACT

A trigger operated dispensing device for the discharge of fluids, particularly in a spray. The device comprises a housing including a trigger, which actuates a flexible pump. The flexible pump has an inlet accepting the fluid and an outlet end through which the fluid passes going to the discharge. The flexible pump, preferably of bellows type, is situated in line with and just adjacent to the discharge wherein rotational motion of the trigger results in rotational compression of the pump chamber. In a particularly preferred embodiment, the flexible pump further includes mechanical structure for imparting a radial momentum to the fluid prior to discharge.

23 Claims, 5 Drawing Sheets

TRIGGER OPERATED FLUID DISPENSING DEVICE

BACKGROUND OF THE INVENTION

Dispensing devices for discharging fluid from a supply container, particularly in a spray, are widely known in the prior art. These fluid dispensers traditionally utilize a piston and cylinder as the pump chamber and a spring to provide the piston return force. They include a means for checking the flow of fluid into and out of the pump chamber and a means for discharging the fluid, preferably in a spray. Channels are incorporated into the dispensing device housing to provide a path for the fluid to and from the pump chamber. Examples of such dispensing devices are found in U.S. Pat. Nos. 4,153,203 (Tada) and 4,819,835 (Tasaki). One drawback to such dispensing devices is the great amount of friction between the piston and the cylinder due to the telescopic fit required to maintain a fluid tight seal. This friction, in conjunction with binding of the piston in the cylinder, are sources of energy loss, thereby increasing the required overall energy to dispense the fluid and the required spring energy to return the piston. In addition, the use of the dispenser housing to provide fluid channeling results in a complex part to manufacture. This, in conjunction with the many parts that go into a fluid dispenser of this type, increases the cost of the dispenser.

U.S. Pat. Nos. 3,973,700 (Schmidt), 4,225,061 (Blake), 4,260,079 (Cary), and 4,489,861 (Saito) reveal dispensing devices that utilize a flexible pump, specifically a bellows, to replace the function of the piston, cylinder and return spring. The use of such a flexible pump is substantially free of friction and binding losses associated with the piston and cylinder. However, these dispensing devices still utilize the dispenser housing to channel the fluid. In addition, little attempt is made to reduce the total number of parts in the dispenser assembly. Therefore complexity and cost are similar to the afore mentioned piston and cylinder dispensing devices.

Still other fluid dispensing devices utilize a diaphragm or bladder as the flexible pump. Examples of such are found in U.S. Pat. Nos. 3,749,290 (Micallef), 4,155,487 (Blake), and 4,310,107 (Wesner). These devices are substantially free of friction and binding losses associated with a piston and cylinder. However, these devices also utilize the housing for channeling the fluid, thereby increasing the complexity and cost of that part.

U.S. Pat. Nos. 4,898,307 (Tiramani) and 5,114,052 (Tiramani) reveal a dispensing device that utilizes a flexible pump, specifically a bellows, wherein a fluid channel is formed from the fluid supply container to the discharge nozzle by means of a dip tube and an integrally formed bellows and discharge tube. The bellows is positioned perpendicular to the discharge orifice and in line with the dip tube and as such must have coupling means with the dispensing device's trigger lever arm so as to transfer the rotational motion of the lever arm into translational compression of the bellows. The discharge tube is required to couple the bellows portion with the discharge nozzle and is positioned in line with and adjacent to the discharge nozzle. As such, the discharge tube must be bent 90 degrees with respect to the bellows in the assembled fluid dispensing device. Although this dispensing device eliminates the fluid channeling from the device's housing, the requirement of having to couple the bellows pump with the discharge nozzle through a discharge tube which must be bent 90 degrees with respect to the bellows in assembly makes for a costly and complicated part. In addition, the discharge tube is additional pressure drop between the bellows and the discharge nozzle. Further, since the discharge tube is formed integral with the bellows, it is made of the same resilient material. Dispensing devices of this type may store flow energy within the discharge tube thereby causing the discharge nozzle to dribble or not have clean flow cutoff.

Other prior art devices simplify the fluid channel by positioning the flexible pump in line with and adjacent to the discharge orifice. Examples of such fluid dispensers, utilizing a bellows as the flexible pump, are found in U.S. Pat. Nos. 2,774,518 (Greene), 3,124,275 (Lake), and 4,732,549 (von Schuckmann). These fluid dispensers provide means for a fluid channel comprising a dip tube, a bellows pump and a nozzle actuator. However, these fluid dispensing devices require direct coupling means between the displacement motion of the nozzle actuator and the compression of the flexible pump, wherein no mechanical advantage or lever action is provided. This is a drawback when the fluid dispenser is used to discharge higher viscosity fluids or fluids in a spray where high pressure losses are present. In addition, these fluid dispensing devices have discharge orifices that move with the motion of the nozzle actuator, thereby increasing the difficulty of depositing fluid with precision.

U.S. Pat. No. 4,101,057 (LoMaglio) discloses a dispensing device that utilizes a flexible pump, specifically a bladder, wherein the bladder is positioned in line with and directly adjacent to the nozzle discharge orifice. A coupling means is provided between a trigger and the bladder so that rotational motion of the trigger lever arm results in compression of the bladder. However, in order to complete the fluid path from supply container to discharge orifice, the dispenser incorporates channeling into the housing, thereby increasing the cost and complexity of that part.

OBJECTS OF THE INVENTION

It is, therefore, an object of the present invention to provide an improved fluid dispensing device having fewer number of parts. It is another object of the present invention to provide such an improved fluid dispensing device which will be substantially free of frictional and binding energy losses by utilizing a flexible pump, wherein said flexible pump is directly in line with and adjacent to the discharge of said device wherein the flexible pump is actuated by the device's trigger wherein the rotational motion of the trigger results in rotational compression of the flexible pump.

It is another object of the present invention to provide, in a preferred embodiment, such an improved fluid dispensing device wherein the fluid is discharged in the form of a spray or foam.

A further object of the present invention is to provide such an improved fluid dispensing device wherein the flexible pump, in a preferred embodiment, is a bellows and wherein the biased fluid outlet valve is integrally formed with the pump means reducing the complexity and total number of parts in the dispenser assembly.

DISCLOSURE OF THE INVENTION

The present invention comprises a trigger operated fluid dispensing device for the discharge of fluids, particularly in a spray, from a supply container in response to manual depression of said trigger. Said dispensing device comprises:

(a) a housing for mounting said dispensing device sealingly attached to a supply container;

(b) a trigger attached to said housing and connected to the inlet portion of a flexible pump means using a coupling means, said flexible pump being directly in line with and adjacent to a discharge of said dispensing device, said flexible pump means having an inlet portion in fluid communication with said supply container and an outlet portion in fluid communication with said discharge of said dispensing device wherein rotational motion of said trigger results in rotational compression of said flexible pump means;

(c) a fluid conducting means for transferring fluid from said supply container to said flexible pump means;

(d) a fluid inlet valve and a fluid inlet valve retaining means located at the inlet portion of said flexible pump means wherein releasing said trigger opens said valve allowing fluid to enter said flexible pump means through said fluid conducting means, and depressing said trigger closes said valve preventing fluid inside said pump means from returning to said fluid conducting means;

(e) a nozzle attached to said housing in fluid communication with the outlet portion of said flexible pump means comprising a discharge orifice and an outlet valve seat; and (f) a biased fluid outlet valve contacting said discharge at one end and contacting a cooperating outlet valve seat at the opposite end, wherein said end of the outlet valve in contact with the cooperating valve seat is moved from said seat when the trigger is depressed thereby allowing the fluid in said flexible pump means to pass through said discharge orifice.

The fluid inlet valve permits flow of fluid into the flexible pump means under negative pump pressure and is sealingly engaged under positive pump pressure against an inlet valve seat. A fluid outlet valve permits flow of fluid out of the flexible pump under positive pump means outlet pressure. Said fluid outlet valve contains a biasing means, preferably a spring, wherein the valve is positively and sealingly engaged against a nozzle valve seat.

In a preferred embodiment, the flexible pump means is a bellows and is situated in line with, and directly adjacent to the discharge of said device. In a more preferred embodiment said bellows and the said fluid outlet valve are one piece. Most preferred is a biased fluid outlet valve additionally comprising a pressure swirl atomizer for imparting radial momentum to the fluid prior to discharge so as to produce a spray. The outlet valve biasing spring imparts an initially high resistive opening force on the fluid outlet valve. The trigger further comprises a flexible pump coupler wherein the rotation of the trigger results in rotational compression of the flexible pump means.

The present invention preferable has a means for venting to the fluid supply container, said means preferably provided venting during rotation of the trigger wherein a fluid tight seal between a trigger vent valve and a housing vent valve seat is broken, thereby permitting air to enter the supply container through a gap between the dip tube and a housing vent tube.

BRIEF DESCRIPTION OF THE DRAWINGS

While the specification concludes with claims particularly pointing out and distinctively claiming the present invention, it is believed the present invention will be better understood from the following description in conjunction with the accompanying drawings in which:

DETAILED DESCRIPTION OF THE INVENTION

Figure 1:
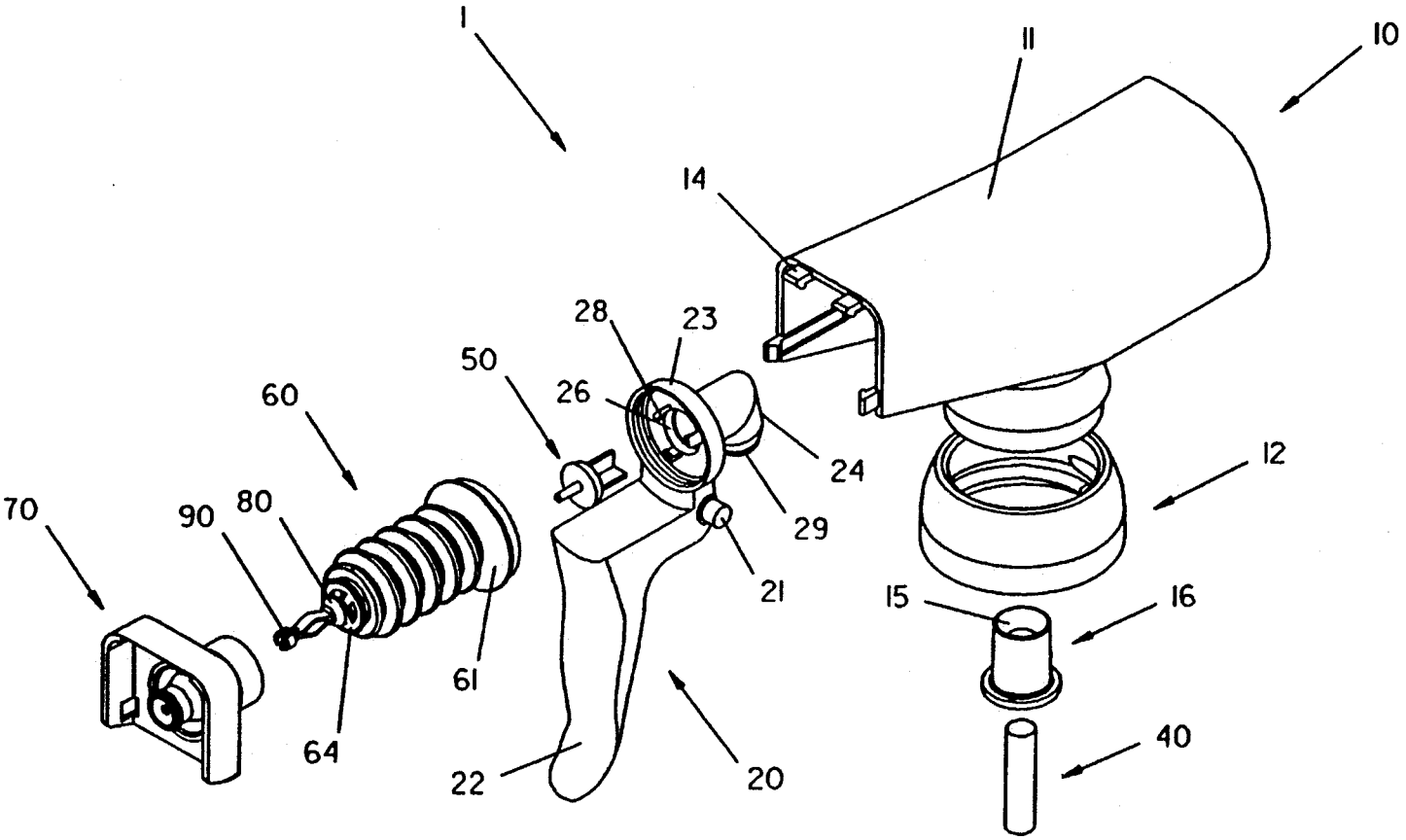
FIG. 1 is an exploded perspective of a fluid dispensing device as an illustrated embodiment of the present invention.
Figure 2:
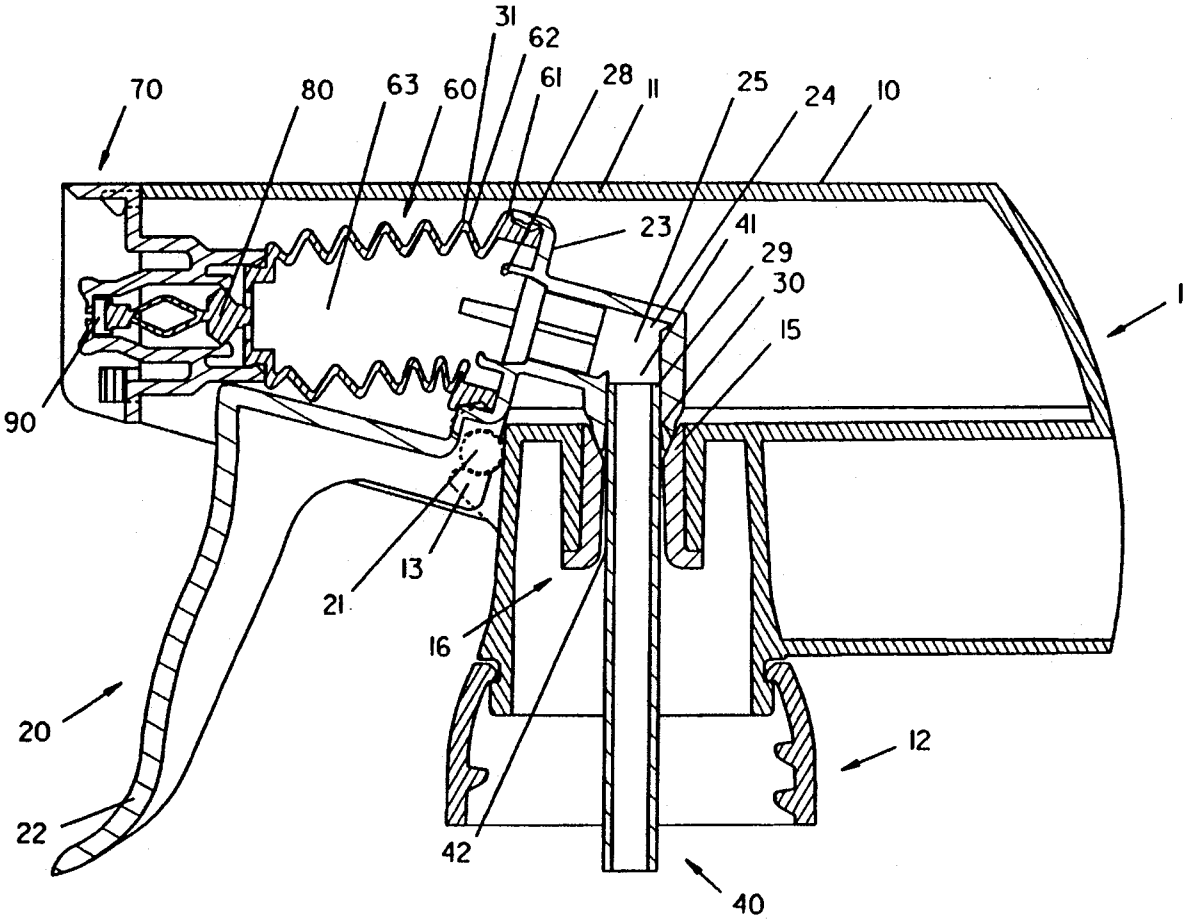
FIG. 2 is a cross-sectional view of an assembled fluid dispensing device of FIG. 1.
Figure 3:
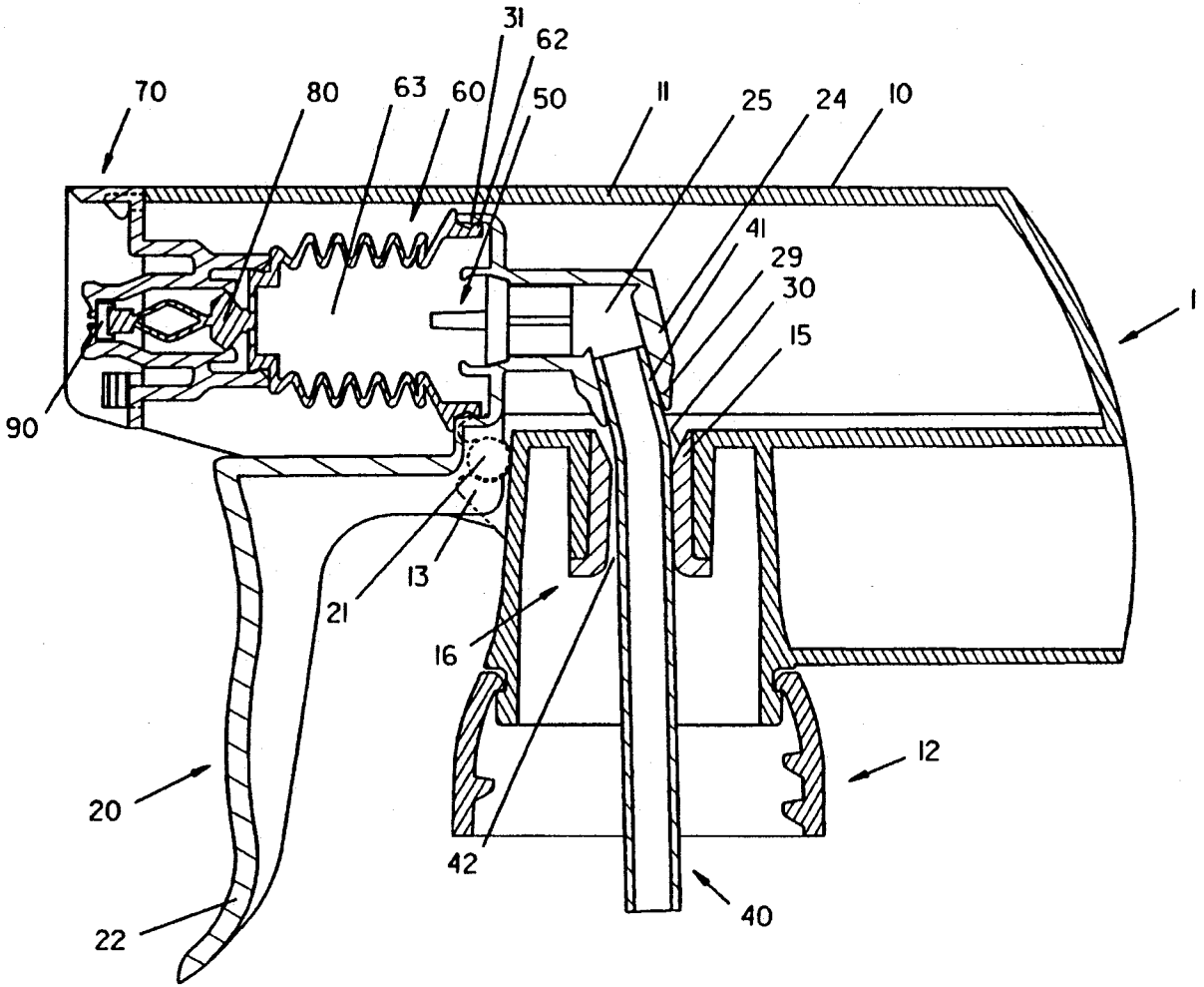
FIG. 3 is a cross-sectional view of an assembled fluid dispensing device of FIG. 1 with the trigger lever arm partially rotated.

In FIG. 1 there is shown in an exploded view a particularly preferred fluid dispensing device 1 of the present invention. A cross-section view of the fully assembled preferred fluid dispensing device 1 is shown in FIG. 2 and in operation in FIG. 3. Housing 10 comprises shroud 11 and closure 12. Housing 10 is used for mounting fluid dispensing device 1 and is sealingly attached to a fluid supply container (not shown). A closure 12 may be integrally molded with shroud 11 by means well known in the art from a thermoplastic material, such as polypropylene, polyethylene or the like. Integrally formed with shroud 11 is c-shaped hinge 13 for retaining trigger 20 and a plurality of tabs 14 for retaining nozzle 70 to shroud 11. Housing 10 may further comprise vent valve seat 15 and vent tube 16, both of which may be integrally molded to either shroud 11 or closure 12.

Trigger 20 is attached to housing 10 by hinge 13 through integral pivot 21. Trigger 20 further comprises lever arm 22, pump coupler 23 and valve seat 26, all preferably integrally injection molded with trigger 20 from a thermoplastic material such as polypropylene, polyethylene, or the like. Pivot 21 is cylindrical in shape and is retained by hinge 13, but can freely rotate about its axis.

Attached to trigger 20 is a fluid conducting means 25. Said fluid conducting means 25 comprises receptacle 24 and dip tube 40. Dip tube 40 is preferably formed of thermoplastic material such as polypropylene, polyethylene, or the like. Pump coupler 23, is at an angle with respect to the receptacle 24. This angle is preferably equal to one half the maximum possible rotational angle of lever arm 22 when fluid dispenser 1 is attached to a fluid supply container (not shown). Upper portion 41 of dip tube 40 is captured by and moves with receptacle 24 when lever arm 22 is rotated about pivots 21. Gap 42 exists between dip tube 40 and vent tube 16 to allow vented air to enter the fluid supply container (not shown).

Figure 4:
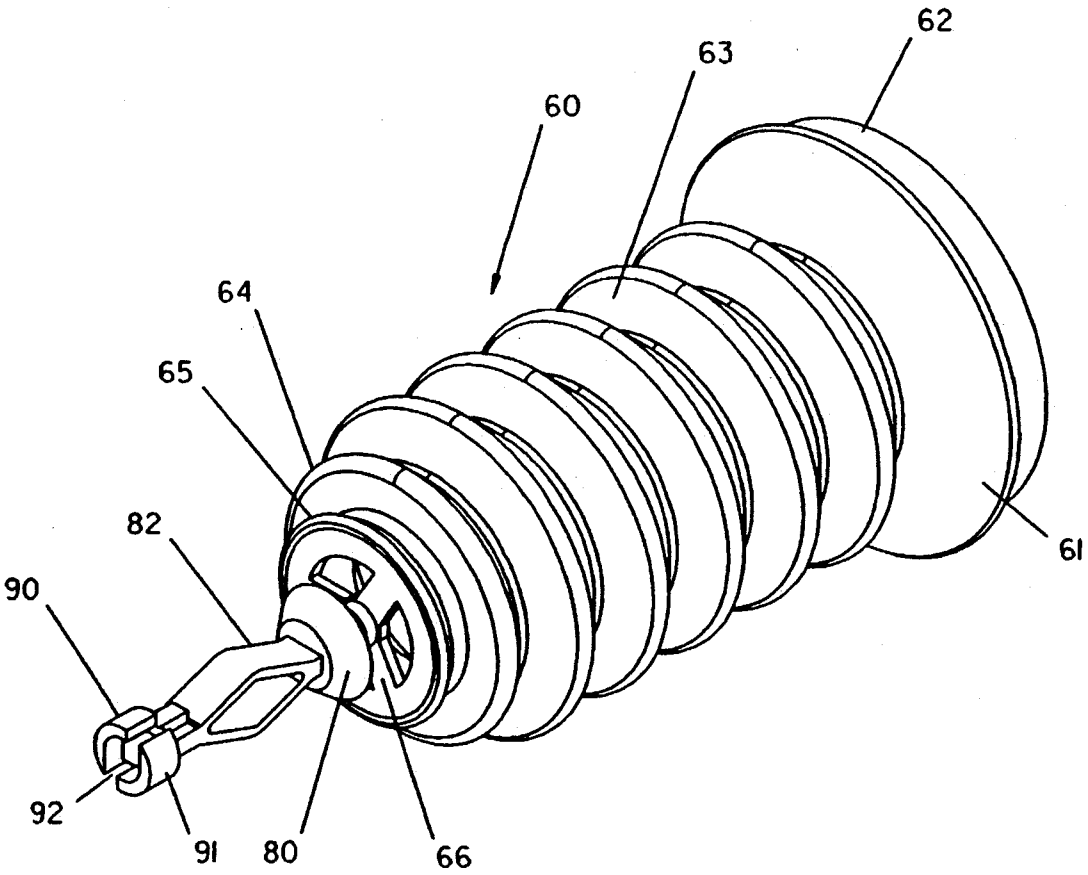
FIG. 4 is an enlarged perspective view of the flexible pump portion of a fluid dispensing device of FIG. 1.

Trigger 20 is connected to inlet portion 61 of flexible pump means 60 using pump coupler 23. Said trigger may be connected to said flexible pump means using lip 31. Seal 62 engages pump coupler 23 so as to provide a fluid tight seal under positive pump pressure. Inlet portion 61 of flexible pump means 60 is in fluid communication with fluid supply container (not shown). Flexible pump means 60, shown in enlarged perspective in FIG. 4, further comprises chamber 63, outlet portion 64 and seal 65. Flexible pump means 60 has a resilient structure which permits said means to be compressed by trigger 20 wherein said means returns to its initial shape when said trigger is released. Said flexible pump means includes diaphragms, bladders and bellows, preferably bellows, as illustrated in FIG. 4. Flexible pump means 60 may be integrally molded from a resilient thermoplastic such as polypropylene, polyethylene or the like, or from an elastomeric material such as a thermoplastic elastomer, rubber, or the like. Alternatively, the bellows is formed out of a helical spring covered with a resilient thermoplastic or elastomeric material of the afore mentioned type, so as to create an enclosed compression chamber.

Fluid inlet valve 50 is located at the inlet portion 61 of flexible pump means 60. Said fluid inlet valve 50 may be of the type generally known in the art including a duckbill, ball, poppit, or the like. In the present invention, the fluid inlet valve 50 is a poppit type that communicates with valve seat 26. Valve seat 26 is conically shaped wherein fluid inlet valve 50 can be sealingly engaged under positive pump pressure. Alternatively, fluid inlet valve 50 may include separate or integral valve seating means. At inlet portion 61 of flexible pump 60 is a fluid inlet valve retaining means, preferably comprising two or more tabs 28, that are circumferentially positioned around valve seat 26 to retain inlet valve 50 under negative pump pressure. Alternatively, inlet valve 50 may include either separate or integral means for retainment under negative pump pressure. Trigger 20 preferably further comprises vent valve 29 for venting the fluid supply container (not shown) to atmosphere. Vent valve 29 is conically shaped and sealingly engages surface 30 of vent valve seat 15 when lever arm 22 is in its at rest position. When trigger 20 is rotated about pivot 21, vent valve 29 disengages from surface 30 of valve seat 15, thereby creating a gap through which air may enter the fluid supply container (not shown).

Figure 5:
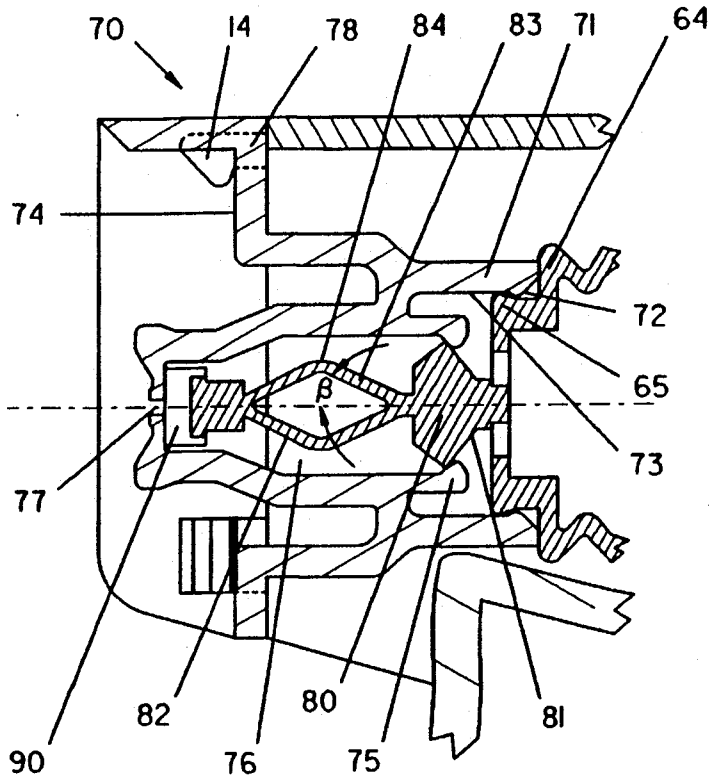
FIG. 5 is an enlarged, partially sectioned, simplified view of a fluid dispensing device of FIG. 1 showing the nozzle portion.

Flexible pump means 60 is directly in line with and adjacent to discharge end of fluid dispensing device 1 with outlet portion 64 of flexible pump means 60 in fluid communication with discharge 77 of nozzle 70, shown in enlarged cross-section in FIG. 5. Nozzle 70 is attached to said housing 10 and is in fluid communication with the outlet portion 64 of said flexible pump means 60 and comprises a discharge 77 and an outlet valve seat 75. Nozzle 70 further comprises pump coupler 71 wherein lip 72 retains outlet portion 64 to nozzle 70. Seal 65 engages surface 73 of pump coupler 71 so as to provide a fluid tight seal under positive pump pressure. Nozzle 70 further comprises face 74 and fluid channel 76. Nozzle 70 is preferably retained to housing 10 through a plurality of tabs 14 that are positively engaged with an equal number of slots 78 in the nozzle face 74. Nozzle 70 maybe be molded from a thermoplastic material such as polypropylene, polyethylene, or the like.

A biased fluid outlet valve 80 is in contact with discharge 77 at one end and with a cooperating outlet valve seat 75 at the other end wherein said end of said valve 80 in contact with the cooperating outlet valve seat 75 is displaced from said seat 75 when trigger 20 is depressed thereby allowing the fluid in flexible pump 60 to pass through discharge 77. Said valve 80 is sealingly engaged against valve seat 75 through surface 81. If the discharged fluid is to be in the form of a spray, said valve 80 may additionally comprise a means for imparting radial momentum to the fluid just prior to existing said discharge 77. This can be achieved through pressure swirl atomizer 90, of the type generally known in the art. Such a pressure swirl atomizer 90 typically comprises cylindrical cup 91 with a plurality of slots 92 tangential to the flow of fluid out discharge 77. Slots 92 are perpendicular to discharge 77. Pressure swirl atomizer 90 may be molded integral with said valve 80 and biasing spring 82. Further, said valve 80 with biasing spring 82 and pressure swirl atomizer 90 may, if desired, be integrally formed with flexible pump 60, as shown in FIG. 4. In this embodiment, said valve 80 is integrally attached to the outlet portion 64 through two or more integrally formed flexible legs 66 that radially extend like spokes from valve 80 to seal 65. Alternatively, pressure swirl atomizer 90 may be molded integral with the discharge 77.

In case the fluid is to be discharged in the form of a spray, biasing spring 82 provides an initially high resistive opening force on fluid outlet valve 80. This resistive force ensures that the pressure of the fluid within flexible pump means 60 will be sufficiently high before the fluid enters pressure swirl atomizer 90. The initially high resistive force may be achieved through the use of a diamond shaped toggle spring of the type shown in FIG. 5 wherein spring 82 functions like a toggle joint of the type generally known in the art, and wherein undeformed legs 83 are at small angle Beta ($\beta$) with respect to the axis of fluid outlet valve 80. In this state, the product of the force of biasing spring 82 and the $\beta$ force vector in line with said valve 80 is near maximum. As the positive fluid pressure within chamber 63 acts upon surface 81 of fluid outlet valve 80, spring legs 83 flexibly rotate about corners 84 and angle Beta, ($\beta$), increases, thus decreasing the $\beta$ force vector multiplier. Alternatively, this initially high resistive force may be achieved through preloading of biasing spring 82 if the shape of the biasing spring 82 is helical, straight, diamond or the like.

In operation of fluid dispenser 1, lever arm 22 of trigger 20 is manually depressed so as to permit the rotation of trigger 20 about pivot 21. Since trigger 20 is attached to flexible pump means 60 through pump coupler 23, this rotational motion of trigger 20 results in rotational compression of flexible pump means 60. The resultant compression creates a positive pressure within chamber 63. This depression of trigger 20 closes inlet valve 50 preventing fluid inside flexible pump means 60 from returning to said fluid conducting means 25. This positive pressure created within chamber 63 during the depression of trigger 20 forces fluid inlet valve 50 to sealingly engage valve seat 26. Seal 65 engages surface 73 and seal 62 engages pump coupler 23 under this positive pump pressure. This positive pressure also acts upon fluid outlet valve 80 and when the pressure reaches a level high enough to cause flexure of legs 66 and spring legs 83, said valve 80 disengages from valve seat 75. Fluid in chamber 63 then flows under pressure around the annular gap created between fluid outlet valve 80 and valve seat 75. The fluid will continue to flow under pressure through fluid channel 76 and into slots 92 of the pressure swirl atomizer 90. The fluid then follows the cylindrical profile of cup 91 so as to gain a radial momentum prior to exiting discharge 77. The combination of radial and axial momentum causes the fluid to exit discharge 77 in a thin conical sheet which quickly breaks up into fluid particles.

Alternatively, the fluid may be discharged in a foam or combination of spray and foam. Nozzle 70 may comprise means, of the type generally known in the art, of mixing air with the fluid prior to or after the fluid exits discharge 77. Air may be drawn into and mixed with the fluid through lowering the pressure of the flowing fluid to below atmosphere through use of a venturi, secondary flow, impingement, static mixer, screen or the like. Alternatively, air may be introduced and mixed with the fluid through pumping means.

When lever arm 22 of trigger 20 is released, flexible pump means 60 restores itself to its uncompressed state. Since flexible pump means 60 is attached to trigger 20 through coupler 23, the resulting restorative energy of flexible pump means 60 rotates lever arm 22 about pivot 21 to its original position. As flexible pump means 60 returns to its original uncompressed state, a negative pressure, or vacuum, is created within chamber 63. This negative pressure, along with biasing spring 82, forces fluid outlet valve 80 to sealingly engage valve seat 75. This negative pressure created within chamber 63 by releasing trigger 20 opens fluid inlet valve 50, disengaging it from corresponding valve seat 26 allowing fluid to enter flexible pump means 60 through fluid conducting means 25. Tabs 28 limit the amount of disengagement of fluid inlet valve 50. This negative pressure within chamber 63 causes fluid within the fluid supply container (not shown), which is at atmospheric pressure, to flow up dip tube 40, into said fluid conducting means 25, through the annular gap created between fluid inlet valve 50 and valve seat 26 and into chamber 63.

The fluid supply container (not shown) may be vented to atmospheric pressure when lever arm 22 is depressed. The means for venting the present container can be any of those known in the art and are preferably said means is located in the upper portion of the supply container (not shown). In the present invention the means for venting preferably comprises a vent valve 29 attached to trigger 20 and a vent valve seat 15 attached to said housing 10 wherein a gap is formed during rotation of trigger 20 between vent valve 29 and vent valve seat 15. Air then flows through the gap created between said valve 29 and surface 30 of vent valve seat 15 and into the fluid supply container (not shown) through gap 42 between dip tube 40 and vent tube 16. Dip tube 40 is retained at its upper portion 41 by trigger receptacle 24. When trigger 20 rotates about pivot 21, upper portion 41 of dip tube 40 flexes and follows the natural arc of receptacle 24.

What is claimed is:

1. A trigger operated dispensing device for the discharge of fluids in response to manual depression of the trigger, said dispensing device comprising:

(a) a housing for sealingly mounting said dispensing device to a supply container;

(b) a trigger attached to said housing and connected to an inlet portion of a flexible pump means using a coupling means, said flexible pump means being directly in line with and adjacent to a discharge of said dispensing device, said flexible pump means having the inlet portion in fluid communication with said supply container and an outlet portion in fluid communication with said discharge of said dispensing device wherein rotational motion of said trigger results in rotational compression of said flexible pump means;

(c) a fluid conducting means for transferring fluid from said supply container to said flexible pump means;

(d) a fluid inlet valve and a fluid inlet valve retaining means located at the inlet portion of said flexible pump means wherein releasing said trigger opens said valve allowing fluid to enter said flexible pump means through said fluid conducting means, and depressing said trigger closes said valve preventing fluid inside said pump means from returning to said fluid conducting means;

(e) a nozzle attached to said housing in fluid communication with the outlet portion of said flexible pump means comprising the dispensing device discharge and an outlet valve seat; and (f) a biased fluid outlet valve contacting said discharge at one end, and contacting said outlet valve seat at the opposite end, wherein said end of the outlet valve in contact with the valve seat is displaced from said seat when the trigger is depressed thereby allowing the fluid in said flexible pump means to pass through said discharge.

2. A dispensing device of claim 1 wherein said trigger, said fluid inlet valve retaining means, said coupling means and said fluid conducting means are integrally formed.

3. A dispensing device of claim 2 additionally comprising an inlet valve seat integrally formed with said means for retaining said fluid inlet valve.

4. A dispensing device of claim 1 wherein said flexible pump means is a bellows formed from materials selected from the group consisting of resilient thermoplastics, elastomers and mixtures thereof.

5. A dispensing device of claim 4 wherein the resilient thermoplastics are selected from the group consisting of polyethylene, polypropylene, and mixtures thereof.

6. A dispensing device of claim 5 wherein said bellows is integrally formed with said biased fluid outlet valve.

7. A dispensing device of claim 6 wherein said outlet valve is biased using a spring integrally formed within said outlet valve.

8. A dispensing device of claim 7 wherein the biased fluid outlet valve additionally comprises a means for imparting a radial momentum to the fluid just prior to exiting said discharge.

9. A dispensing device of claim 8 wherein the biasing spring imparts an initially high resistive opening force on said fluid outlet valve.

10. A dispensing device of claim 1 wherein the fluid conducting means is a dip tube connected to a receptacle attached to said coupling means.

11. A dispensing device of claim 10 additionally comprising a means for venting said supply container located in the upper portion of said supply container.

12. A dispensing device of claim 11 wherein said means for venting comprises a vent valve attached to said trigger and a vent valve seat attached to said housing wherein a gap is formed, during rotation of the trigger, between said vent valve and said vent valve seat.

13. A trigger operated spray dispensing device for the discharge of fluids in response to manual depression of the trigger, said dispensing device comprising:

(a) a housing for sealing mounting said dispensing device to a supply container;

b) a trigger attached to said housing and connected to an inlet portion of a bellows using coupling means, said bellows being directly in line with and adjacent to a discharge of said dispensing device, said bellows having the inlet portion in fluid communication with said supply container and an outlet portion in fluid communication with the discharge of said dispensing device wherein rotational motion of said trigger results in rotational compression of said bellows;

(c) a fluid conducting means for transferring fluid from said supply container to said bellows comprising a dip tube connected to a receptacle attached to said coupling means.

d) a fluid inlet valve cooperating with an inlet valve seat, located at the inlet portion of said bellows and an inlet valve retaining means wherein releasing said trigger opens said valve allowing fluid to enter said bellows through said dip tube, and depressing said trigger closes said valve preventing fluid from said bellows from returning to said dip tube;

(e) a nozzle attached to said housing in fluid communication with the outlet portion of said bellows comprising the dispensing devices discharge and an outlet valve seat; and (f) a biased fluid outlet valve contacting said discharge at one end, and contacting said outlet valve seat at the opposite end wherein said end of the outlet valve in contact with the outlet valve seat is moved from said seat when the trigger is depressed thereby allowing the fluid in said bellows to pass through said discharge.

(g) a means for imparting radial momentum to the fluid prior to discharge.

14. A dispensing device of claim 13 wherein the trigger, coupling means, receptacle, inlet valve retaining means, and inlet valve seat are integrally formed.

15. A dispensing device of claim 14 wherein said bellows is made from a material selected from the group consisting of resilient thermoplastics, elastomers and mixtures thereof.

16. A dispensing device of claim 15 wherein the resilient thermoplastics are selected from the group consisting of polyethylene, polypropylene, and mixtures thereof.

17. A dispensing device of claim 16 wherein said bellows is integrally formed with said biased fluid outlet valve.

18. A dispensing device of claim 17 wherein said outlet valve is biased using a spring integrally formed within said outlet valve.

19. A dispensing device of claim 18 wherein the biased fluid outlet valve is integrally formed with said means for imparting a radial momentum to the fluid prior to discharge.

20. A dispensing device of claim 19 wherein the biasing spring imparts an initially high resistive opening force on said fluid outlet valve.

21. A dispensing device of claim 13 additionally comprising a means for venting said supply container located in the upper portion of said supply container.

22. A dispensing device of claim 21 wherein said means for venting comprises a vent valve attached to said trigger and a vent valve seat attached to said housing wherein a gap is formed, during rotation of the trigger, between said vent valve and said vent valve seat.

23. A trigger operated fluid dispensing device for the discharge of fluid from a supply container, said fluid dispensing device comprising a housing for sealingly attaching the fluid dispensing device to said fluid supply container, a trigger, a dip tube attached to said trigger, a flexible pump means attached to said dip tube, a fluid inlet valve between said dip tube and said flexible pump means, a discharge, and a fluid outlet valve between said flexible pump means and said discharge, wherein the improvement is said pump means being directly in line with and adjacent to said discharge of said dispensing device, said flexible pump means having an inlet portion in fluid communication with said supply container and an outlet portion in fluid communication with said discharge of said dispensing device wherein rotational motion of said trigger results in rotational compression of said flexible pump means.

* * * * *